United States Patent [19]

Onda et al.

[11] 4,252,163

[45] Feb. 24, 1981

[54] WOOD-PLANING AND FINISHING MACHINE

[75] Inventors: Hirotsuga Onda; Kojiro Onda, both of Seki, Japan

[73] Assignee: Onda Ironworks Company, Limited, Seki, Japan

[21] Appl. No.: 53,248

[22] Filed: Jun. 29, 1979

[30] Foreign Application Priority Data

Nov. 30, 1978 [JP] Japan ..... 53-148809

[51] Int. Cl.[3] ..... B27C 1/00

[52] U.S. Cl. ..... 144/132; 144/130; 83/699

[58] Field of Search ..... 144/120, 132, 129, 130, 144/117 R; 83/699

[56] References Cited

U.S. PATENT DOCUMENTS

| | | | |
|---|---|---|---|
| 1,814,726 | 7/1931 | Miller | 144/130 X |
| 3,727,654 | 4/1973 | Mochizuki | 144/120 |
| 4,195,675 | 4/1980 | Hupkes et al. | 144/120 |

FOREIGN PATENT DOCUMENTS

| | | | |
|---|---|---|---|
| 506080 | 8/1930 | Fed. Rep. of Germany | 144/120 |
| 1292286 | 3/1962 | France | 144/120 |

*Primary Examiner*—Willie G. Abercrombie
*Attorney, Agent, or Firm*—Jordan and Hamburg

[57] ABSTRACT

A wood-planing and finishing machine in which a cutting tool is secured to a knife stock through a mounting plate. The mounting plate is mounted on the inclined mounting surface of the knife stock in such a manner that the tilting angle of the former, and therefore its vertical position, can be adjusted by means of a wedge member. The degree of projection of the tool increases when the upper end of the mounting plate is tilted upwardly, and decreases when it is tilted downwardly. The mounting plate is secured by the wedge member against tilting and vertical movements resulting from a resisting force acting on the tool during operation.

8 Claims, 12 Drawing Figures

WOOD-PLANING AND FINISHING MACHINE

FIELD OF THE INVENTION

This invention relates generally to a wood-planing and finishing machine, and more particularly to a mechanism for adjusting the position of the cutting edge of the machine.

BACKGROUND OF THE INVENTION

Conventional mechanisms for adjusting the position of the cutting edge in wood-planing and finishing machines have such a construction that a cutting tool 41, as shown in FIG. 11, is secured by a bolt 42 to an inclined mounting surface 40*a* of the knife stock 40 in such a manner as to be slightly tiltable, and that between the cutting tool 41 and the inclined surface 40*a* there is interposed a wedge-like adjusting member 43 which is slid in the direction of the width of the feeder table to change the tilting angle of the cutting tool 41 and therefore the degree of projection thereof from the feeder table.

Furthermore, in the conventional adjusting mechanism, a guide blade 51 is secured to a cutting blade 61 through a bolt 44, and the cutting blade 61 is directly abutted against the inclined surface 40*a* of the knife stock 40, with the cutting blade 61 and the guide blade 51 being attached to the knife stock 40 by another bolt 42 which is passed through the cutting blade 61 from the guide blade 51 and screwed into the stock 40.

Generally, it is necessary that a delicate positional relationship be maintained between the cutting blade 61 and the guide blade 51. Specifically, when the cutting blade 61 and guide blade 51 are assembled, the guide blade 51 must be slightly retracted from the cutting blade 61. The degree of this retraction has a great effect on how well the cutting will be performed. A gap 45 is formed between the blades 51 and 61 when they are assembled as shown in FIG. 12. For a fine adjustment of the relative position between these blades, the bolt 44 is tightened to slightly bend the central portion of the guide blade 51 into the gap 45 thereby finely adjusting the position of the cutting edge of the guide blade 51 up or down.

However, the conventional cutter adjusting mechanism with the construction shown in FIG. 11 has the following disadvantage. Since the guide blade 51 is being forced toward the cutting blade 61 by the fixing bolt 42 which secures the cutting tool 41 to the knife stock 40, the relative position between the cutting edges of the blades 51 and 61 which has been accurately set beforehand in securing the guide blade 51 to the cutting blade 61 by the bolt 44 will be disturbed when the fixing bolt 42 is re-tightened to adjust the tilting angle of the tool 41. This is because fastening the bolt 42 causes the central part of the guide blade 51 to further bend into the gap 45, which in turn causes the cutting edge of the guide blade 51 to move upwards.

OBJECTS OF THE INVENTION

Figure 1:
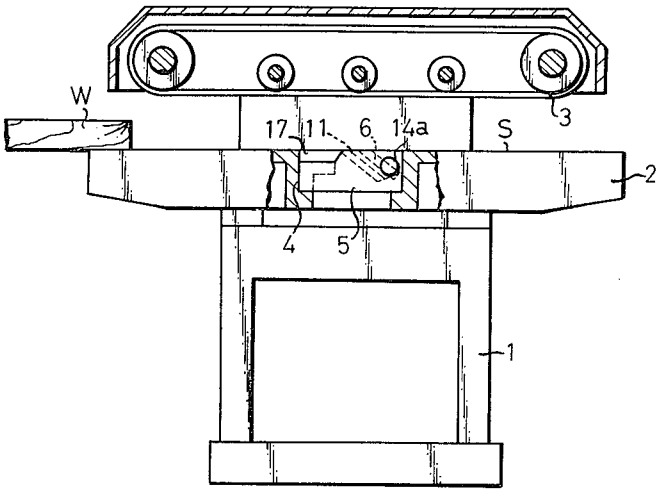
FIG. 1 is a front view, partially broken away, of a first embodiment of the wood-planing and finishing machine according to the present invention.

It is an object of this invention to provide a wood-planing and finishing machine in which fine adjustment of the position of the cutting tool edge can be accurately and easily performed by adjusting the tilting angle of the cutting tool with a simple mechanism.

Another object of this invention is to provide a wood-planing and finishing machine in which even if the cutting edge of the tool is subjected to a large cutting resistance during the planing operation, a change in the tilting angle of the tool can be reliably prevented with a simple mechanism.

Other objects and advantages of this invention will become apparent from the following description of the preferred embodiments and the claims.

DESCRIPTION OF THE INVENTION

Embodiments of the present invention will now be described with reference to the accompanying drawings. In FIGS. 1 through 4 which illustrate a concrete first embodiment of the present invention, reference numeral 1 represents a bed, 2 a feeder table, and 3 a feeder belt which is disposed above the feeder table 2 and adjustable in vertical position for feeding a workpiece W toward a cutting tool.

At the center of the feeder table 2 a fitting groove 4 is formed for detachably receiving a box-shaped knife stock 5.

Figure 4:
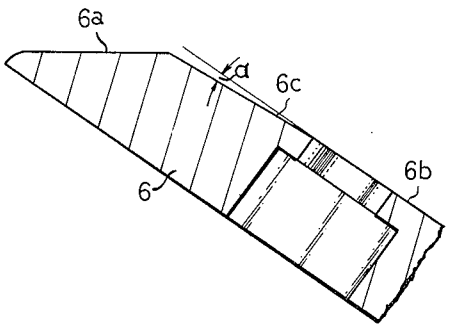
FIG. 4 is an enlarged cross-sectional view of the upper portion of the mounting plate.

A mounting plate 6 for mounting a cutter 11 thereon is secured by means of a bolt 7 at its portion slightly above the center to an inclined mounting surface 5*a* formed on the inner side of the knife stock 5. The mounting plate 6 has a top surface 6*a* which is inclined to coincide with the upper surface S of the feeder table 2. As shown in FIG. 4, the mounting plate 6 has a tapered surface 6*c* on the upper portion of a surface 6*b* contacting the inclined mounting surface 5*a*, the tapered surface 6*c* being inclined at a small angle of ($\alpha$) (35 minutes in this embodiment) away from the opposing surface 5*a*. Using a spring washer 8 on the bolt 7, the mounting plate 6 can be slightly rotated clockwise around the bolt 7 with the bolt 7 tightened. It should be noted, however, that the spring washer 8 may be omitted.

An adjust bolt 9 is screwed through a mounting projection 10, which slopes downwardly extending from the lower end of the inclined mounting surface 5*a*, and is adapted to rotatably abut against the bottom of the mounting plate 6. The mounting plate 6 is finely adjusted in vertical position by rotating the adjust bolt 9 so as to correct the misalignment between the top surface 6*a* of the mounting plate 6 and the upper surface S of the feeder table 2 due to manufacturing or assembly errors in the mounting plate 6.

Figure 3:
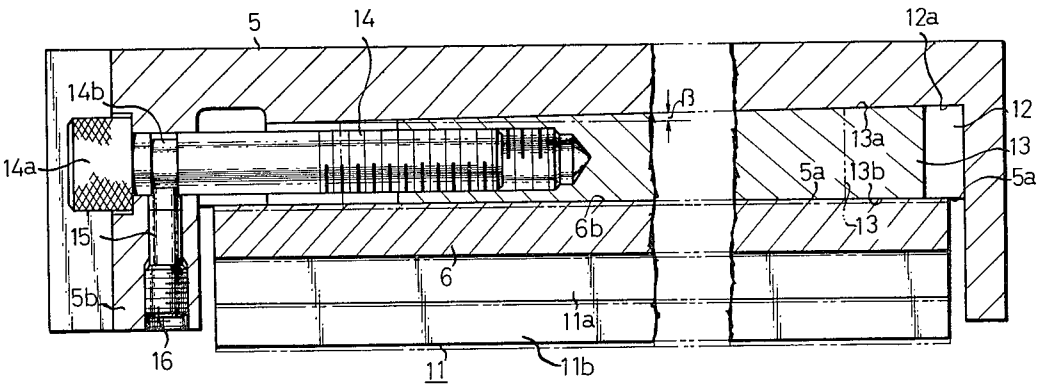
FIG. 3 is a cross-sectional view taken along the line A—A of FIG. 2.

A cutter 11 consisting of a cutting blade 11*a* and a guide blade 11*b* is bolted to the lower surface of the mounting plate 6 in such a manner that the degree to which the cutter 11 projects above the upper surface of the feeder table 2 is roughly adjustable. The lower portion of the inclined mounting surface 5*a* of the knife stock 5 is formed with a longitudinally extending guide groove 12 having a channel-shaped cross section, the inner, upper surface of the guide groove 12 being formed into a tapered surface 12 a which is slightly tapered along its length from the inclined mounting surface 5*a* at an inclination angle of ($\beta$) (1 degree in this embodiment). Received in this guide groove 12 is a wedge member 13 of a square pillar configuration which is capable of reciprocating horizontally in the groove. The wedge member 13 has a tapered surface 13*a* in sliding contact with and having the same inclination angle ($\beta$) as the tapered surface 12*a* of the guide groove 12 and also has a pressing surface 13*b* which slidably bears against the surface 6*b* of the mounting plate 6 and extends parallel to the inclined mounting surface 5*a*. An adjust bolt 14 is screwed into the wedge member 13 through the front outer wall 5*b* of the knife stock 5, as shown in FIG. 3. Near its adjustment knob 14*a*, the adjust bolt 14 has a neck portion 14*b* which receives a stopper pin 15 supported by a bolt 16 inserted from under the outer wall 5*b* so that the adjust bolt 14 is secured against axial movement but capable of rotary movement in a fixed position.

Numeral 17 denotes a guide secured to the knife stock 5, the upper surface of the guide lying in the same plane as the upper surface S of the feeder table 2.

Figure 2:
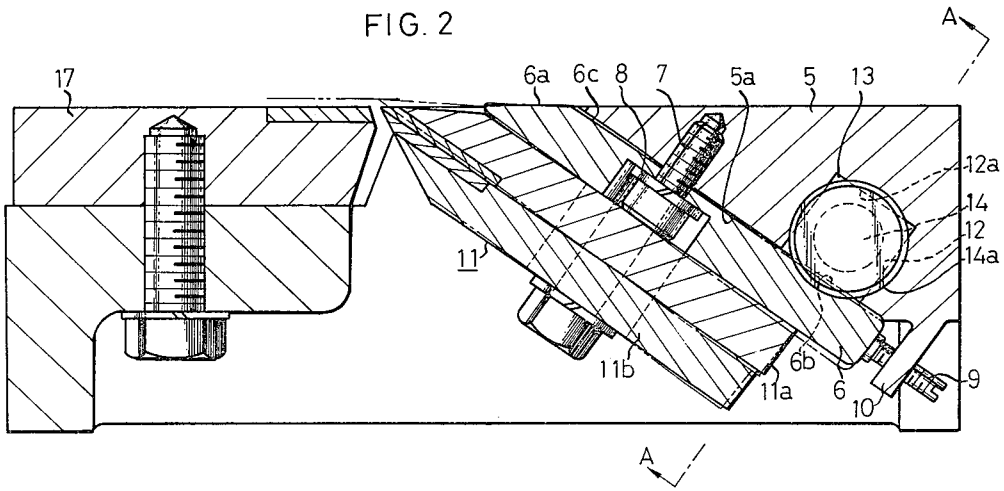
FIG. 2 is an enlarged cross-sectional view of the knife stock of the machine.

In FIG. 3, when the wedge member 13 is moved from the position indicated by the solid line to the position indicated by the two-dot chain line by rotating the adjust bolt 14, the tapered surface 13*a* of the wedge member 13 slides along the tapered surface 12*a* of the guide groove 12 and the pressing surface 13*b* is slightly projected from the guide groove 12, thereby pushing the lower part of the surface 6*b* of the mounting plate 6 so that the mounting plate 6, and therefore the cutting tool 11, are slightly rotated clockwise about the bolt 7, as shown in FIG. 2. As a result, the cutting edge of the cutting tool 11 is slightly projected as indicated by the two-dot chain line.

When the adjust bolt 14 is rotated in the reverse direction, the wedge member 13 is shifted from the position indicated by the two-dot chain line toward the position of the solid line in FIG. 3 and the pressing surface 13*b* is retracted into the guide groove 12, with the result that the mounting plate 6 and the cutting tool 11 are rotated counterclockwise around the bolt 7, as shown in FIG. 2, thereby lowering the cutting edge.

This method adjusting the position of the cutting edge obviates the necessity of fastening or loosening the bolt for attaching the cutting tool 11. Therefore, the relationship between the mounting positions of the cutting blade 11*a* and the guide blade 11*b* will not be disturbed.

The degree of change in the projection of the cutting blade per one turn of the adjust bolt 14 is determined by the screw pitch of the bolt 14 and the angle of inclination of the tapered surface of the wedge member 13.

Now, the second embodiment of the present invention will be described with reference to FIGS. 5 through 10.

A groove 21 is cut on the inclined mounting surface 5*a* to the upper left of the aforementioned guide groove 12 and extends in the same direction as does the groove 12. Secured in this groove 21 by a plurality of bolts 23 is a support block 22 of square pillar configuration whose lower portion projects into the guide groove 12. The upper surface of the lower portion of the support block 22 is formed into a tapered surface 22*a* which extends in parallel with and has the same angle of inclination as the tapered surface 12*a* of the guide groove 12, and its lower surface lies in the same plane as the inclined mounting surface 5*a* of the knife stock 5. This groove 12 is formed as a dovetail groove which becomes wider and broader upwardly.

Received in the guide groove 12 is a wedge member 24 of dovetail configuration which is capable of reciprocating horizontally in the groove. The wedge member 24 has a first tapered surface 24*a* engaging with and having the same inclination angle ($\beta$) as the tapered surface 12*a* of the guide groove 12, a second tapered surface 24*b* engaging with and having the same inclination angle ($\beta$) as the tapered surface 22*a* of the support block 22, and a pressing surface 24*c* engaging with the surface 6*b* of the mounting plate 6 and parallel with the inclined mounting surface 5*a*. Two guide pins 25 are screwed through the lower end of the wedge member 24 and their unthreaded top portions 25*a* of reduced diameter are received in a pair of slots 26 formed on the bottom of the mounting plate 6 in such a manner as to allow the horizontal reciprocating movement of the wedge member 24 but prevent the vertical movement thereof relative to the mounting plate 6.

Figure 7:
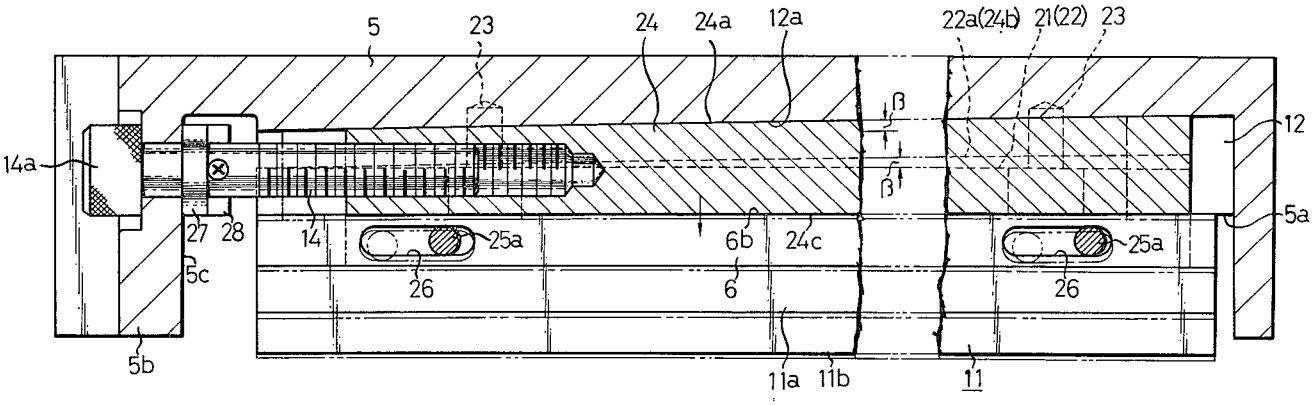
FIG. 7 is a cross-sectional view taken along the line B—B of FIG. 5.

As can be seen in FIG. 7, an adjust bolt 14 has a collar 27 fitted around its shank and secured by a pin 28 so as to slidably contact the inner surface 5*c* of the outer wall 5*b* of the knife stock 5, whereby the adjust bolt 14 is secured against axial movement but capable of rotary movement in a fixed position.

In FIG. 7, when the wedge member 24 is moved from the position indicated by the solid line to the position indicated by the two-dot chain line by rotating the adjust bolt 14, the first and second tapered surfaces 24*a* and 24*b* slide along the tapered surfaces 12*a* and 22*a* of the guide groove 12 and of the support block 22, respectively, and the pressing surface 24*c* is moved slightly away from the guide groove 12 in the direction indicated by the arrow. As a result, the pressing surface 24*c* pushes the lower portion of the surface 6*b* of the mounting plate 6, slightly rotating both the mounting plate 6 and the cutting tool 11 clockwise around the bolt 7, so that the cutting edge of the tool 11 is projected by a slight amount as indicated by the two-dot chain line in FIG. 5. At the same time, the guide pins 25 provided on the lower end of the wedge member 24 also move downwardly and slide in the slots 26 of the mounting plate 6 towad the left in FIG. 7 while moving downwardly along with the wedge member 24.

Figure 5:
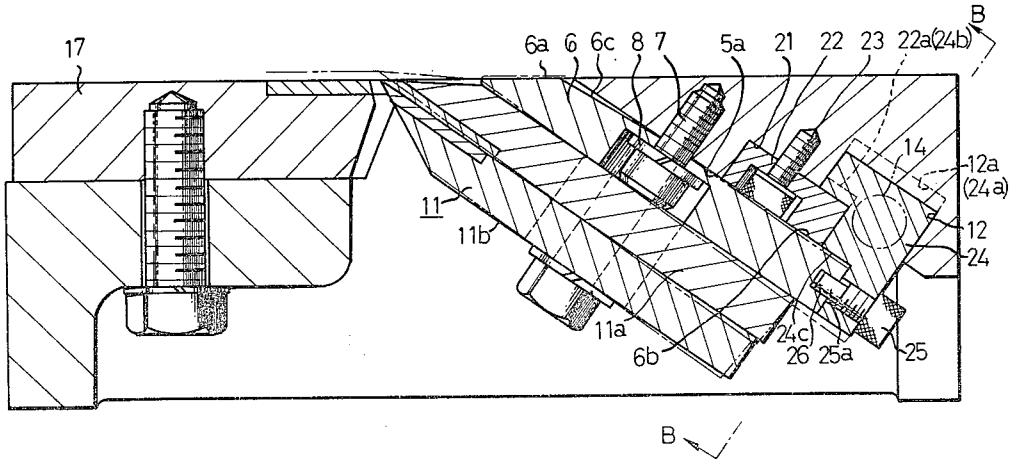
FIG. 5 is a cross-sectional view of the knife stock of a second embodiment of the invention.

In cutting the workpiece W by the planer machine with the cutting edge of its cutting tool 11 adjusted in the way aforementioned, the cutting tool 11, depending on the quality of the workpiece W to be cut and the cutting direction, may be subjected to a great resistance that tends to rotate the mounting plate 6 clockwise about the bolt 7, as best illustrated in FIG. 5. However, in the second embodiment, the wedge member 24 has a dovetail configuration which prevents vertical movement thereof relative to the guide groove 12, and the vertical relative movement between the mounting plate 6 and the wedge member 24 is also restricted by the guide pins 25 interconnecting them. This will prevent the mounting plate 6 from separating away from the pressing surface 24*c* of the wedge member 24 so that the cutting edge of the cutting tool 11 will be reliably kept in the adjusted position and the thickness of the planed material will be constant and accurate.

To reduce the degree of projection of the cutting tool 11, the adjust bolt 14 has only to be rotated in the reverse direction. At this time, the mounting plate 6 is forcibly moved toward the inclined mounting surface 5*a* of the knife stock by the guide pins 25 provided on the wedge member 24 which withdraws into the guide groove 12. The cutting edge of the tool 11 can therefore be adjusted and fixed in the withdrawn position.

Figure 9:
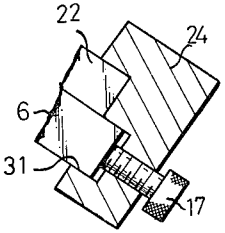
FIGS. 8 and 9 are perspective view and a cross-sectional view, respectively, of another means for guiding the lower end of the mounting plate.
Figure 10:
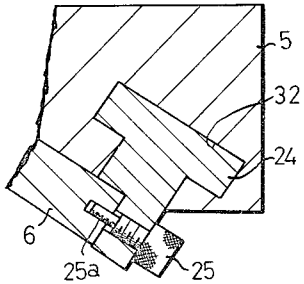
FIG. 10 is a cross-sectional view of the T-shaped guide groove and the wedge member received in the guide groove.
Figure 6:
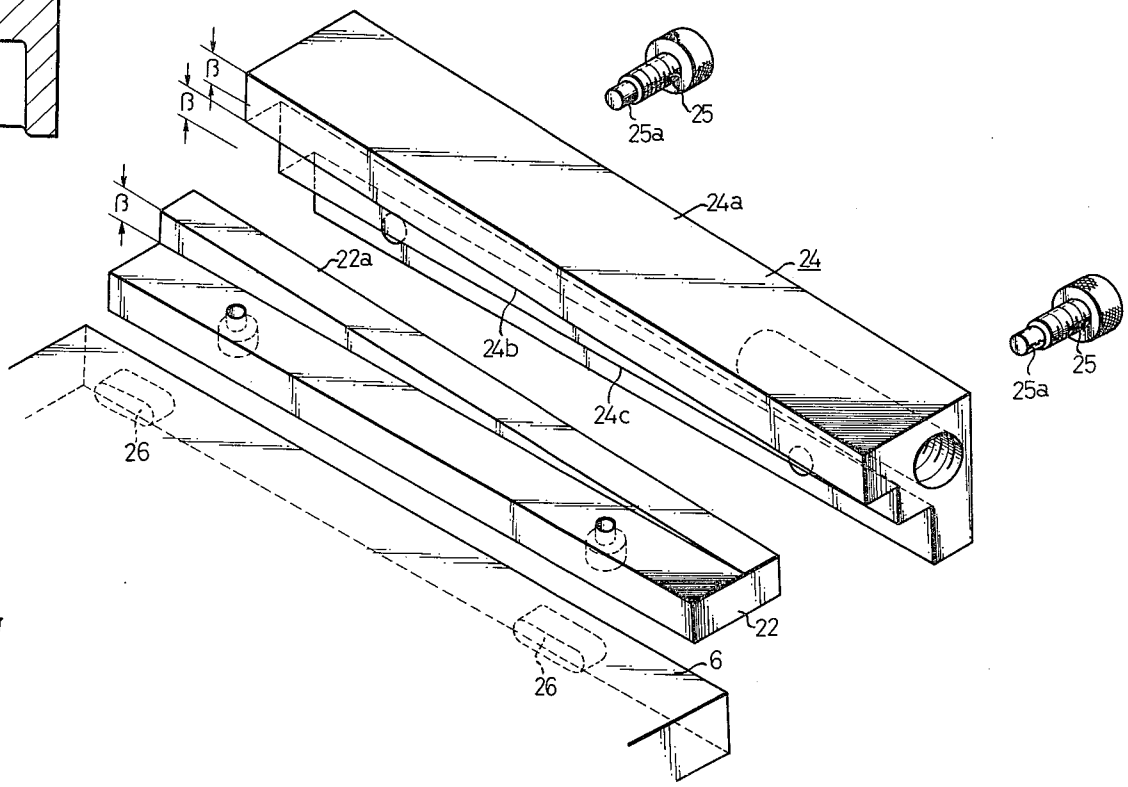
FIG. 6 is an enlarged and exploded perspective view of a portion of the knife stock shown in FIG. 5.
Figure 11:
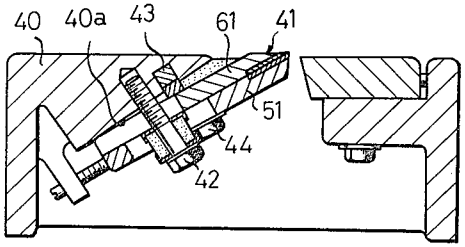
FIG. 11 is a cross-sectional view of the conventional cutting tool adjusting mechanism for the planer machine.
Figure 12:
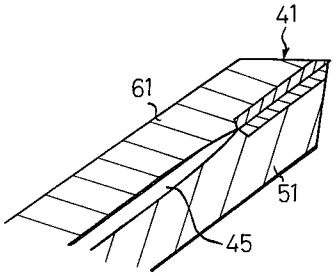
FIG. 12 is an enlarged cross-sectional view of a portion of the cutting tool shown in FIG. 11.
Figure 8:
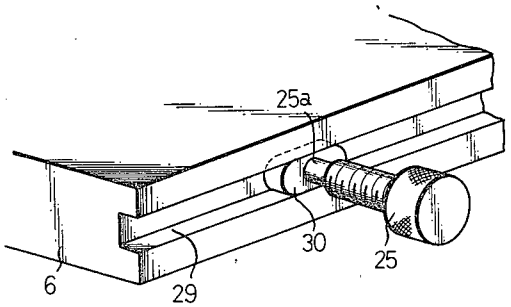

This invention can also be materialized in the following embodiments in which (A) such mechanisms as a cam, other than the adjust bolt 14 and the wedge member 13, may be employed for tilting both the mounting plate 6 and the cutting tool 11;

(B) means for indicating the degree of projection of the cutting edge is provided around the adjust bolt 14 on the outer surface of the knife stock 5;

(C) the upper portion of the inclined mounting surface 5*a* of the knife stock 5 is cut to form a tapered surface so as to allow the mounting plate 6 to rotate, and the lower portion of the surface 6*b* of the mounting plate 6 is also cut to form a tapered surface so as to provide a gap between the inclined mounting surface 5*a* of the knife stock 5 and the mounting plate 6 for increased tilting movement of the mounting plate 6;

(D) the bottom of the mounting plate 6 is formed with an engagement groove 29 and the guide pin 25 has secured at its end an engagement piece 30 which is in surface contact with the groove 29, as shown in FIG. 8;

(E) the wedge member 24 is formed at its lower end with an engagement groove 31 for slidably receiving the lower portion of the mounting plate 6, as shown in FIG. 9; and (F) the wedge member 24 is slidably received in the guide groove 32 formed on the knife stock, the guide groove having a T-shaped cross section.

What is claimed is:

1. A machine for planing wood comprising (A) a table;

(B) a knife stock positioned in said table with the upper surface of said knife stock exposed above said table;

(C) a mounting plate disposed along the underside of said knife stock;

(D) a means for securing said mounting plate to the underside of said knife stock;

(E) adjusting means within said knife stock for rotating said mounting plate about said securing means as center; and (F) a cutting tool affixed to the lower surface of said mounting plate, comprising (1) a cutting blade adjacent the lower surface of said mounting plate, with an upper edge projecting above the knife stock, and (2) a guide blade affixed to the underside of said cutting blade, so that said cutting tool rotates on adjustment of said mounting plate.

2. The machine of claim 1 wherein (D) said securing means comprises at least one bolt inserted into the underside of said knife stock from said mounting plate through a washer, (E) said adjusting means comprises a wedge interposed between the mounting plate and the knife stock at a point below said securing means and extending in the direction of the feeder table width, said wedge having different thicknesses at each of its ends, and the interface between said knife stock (B) and said mounting plate (C) above said securing means (D) is tapered to allow for rotation of said mounting plate about said securing means.

3. The machine of claim 2 wherein said knife stock additionally comprises a projection below the bottom of said mounting plate, and further comprising an adjustment bolt adapted to be inserted through said projection to bear against the bottom of said mounting plate for adjusting the vertical position of said mounting plate.

4. The machine of claim 2 wherein said knife stock additionally comprises a guide groove extending in the direction of the table width at a point below said securing means for receiving said wedge, and further comprising an adjustable bolt inserted into said wedge so that adjustment of said bolt will rotate said mounting plate about said securing means.

5. The machine of claim 4 wherein said guide groove is substantially channel-shaped with a tapered upper surface inclining vertically along the length of the guide groove, and said wedge has a substantially square cross-section with a tapered upper surface inclining vertically along the length of the wedge at the same inclination angle as the upper tapered surface of the guide groove so that upward movement of the wedge member in the guide groove is impossible.

6. The machine of claim 4 wherein said guide groove is of dovetail configuration with its expanded portion inclined vertically along its length, and said wedge is of dovetail configuration so that it is received in said guide groove with upward and downward movement impossible, and said wedge further comprises a guiding means at the lower end of said wedge to retain the bottom of said mounting plate against movement away from said wedge while allowing movement of said mounting plate along the surface of said wedge.

7. The machine of claim 6 wherein said guiding means comprises a plurality of guide pins extending through the lower end of said wedge into receiving slots provided in the bottom of said mounting plate.

8. The machine of claim 6 wherein said guiding means comprises a groove for receiving the bottom of said mounting plate.

* * * * *